United States Patent [19]

Tzong-Lin

[11] Patent Number: 4,824,084

[45] Date of Patent: Apr. 25, 1989

[54] VERSATILE VISE

[76] Inventor: Sheen Tzong-Lin, 22, Lane 2, Liu Bridge E. Rd., Kang Shan Chen, Kaohsiung Hsien, Taiwan

[21] Appl. No.: 166,497

[22] Filed: Mar. 10, 1988

[51] Int. Cl.[4] ..... B25D 1/00

[52] U.S. Cl. ..... 269/87.2; 269/97; 269/246; 269/282; 269/329

[58] Field of Search ..... 29/560.1, 34 R; 408/97, 408/137; 269/82, 83, 76, 88, 87.2, 97, 98, 246, 250, 252, 262, 279, 280, 282, 303, 329; 411/222

[56] References Cited

U.S. PATENT DOCUMENTS

| | | | |
|---|---|---|---|
| 437,047 | 9/1890 | Sargent | 269/246 |
| 717,422 | 12/1902 | Lewin | 269/246 |
| 785,010 | 3/1905 | Lindgren | 269/76 |

*Primary Examiner*—Frederick R. Schmidt
*Assistant Examiner*—David Holmes
*Attorney, Agent, or Firm*—Larson and Taylor

[57] ABSTRACT

A kind of vise comprising a back jaw and a front jaw which are separately provided with a plurality of different jaw faces corresponding to one another for pinching different shapes of things or material, the faces are changeable in their position by turning for choosing the most proper one for pinching a thing to be worked on. A punch set on the screw is also able to punch a hole.

5 Claims, 3 Drawing Sheets

VERSATILE VISE

BACKGROUND OF THE INVENTION

Common vises used in machine shops are generally equipped with only one kind of jaw face for pinching a thing to be worked on. If it is used in a home for pinching a wide variety of things to be worked on, such as bars, pipes, pointed things, etc., it is evidently inconvenient.

SUMMARY OF THE INVENTION

Therefore, the inventor has worked out this versatile vise which is provided with a plurality of jaw faces for pinching various shapes of things and with a punch for punching a hole.

This vise comprises a jaw holder to be fixed on a work bench. The and said jaw holder is provided with a shaft hole which is divided by a groove into two shaft holes, a long one at the front, a short one at the rear. The said jaw holder is also provided with male thread for combining with a back jaw and a nut, said nut being used for loosening or tightening said back jaw on said jaw holder. Said back jaw is provided with a C-shaped hole and a threaded hole. The C-shaped hole is used for a tube shaft of a front jaw to insert. The threaded hole is used for a screw to engage in so that said screw can turn around at its original position to move said front jaw nearer to or further from said back jaw for pinching or releasing a thing between both jaws. The tube shaft is combined at its rear end with a punch, so when said front jaw moves near said back jaw, said punch can insert into a round hole in a punch plate for punching a hole in a thing placed between them. In addition, both said front and back jaws are provided with a plurality of different jaw faces able to be turned around for choosing a proper one to cope with the shape of a thing to be pinched.

BRIEF DESCRIPTION OF THE DRAWINGS

This invention will now be described in detail with reference to accompanying drawings wherein.

DETAILED DESCRIPTION OF THE INVENTION

Figure 1:
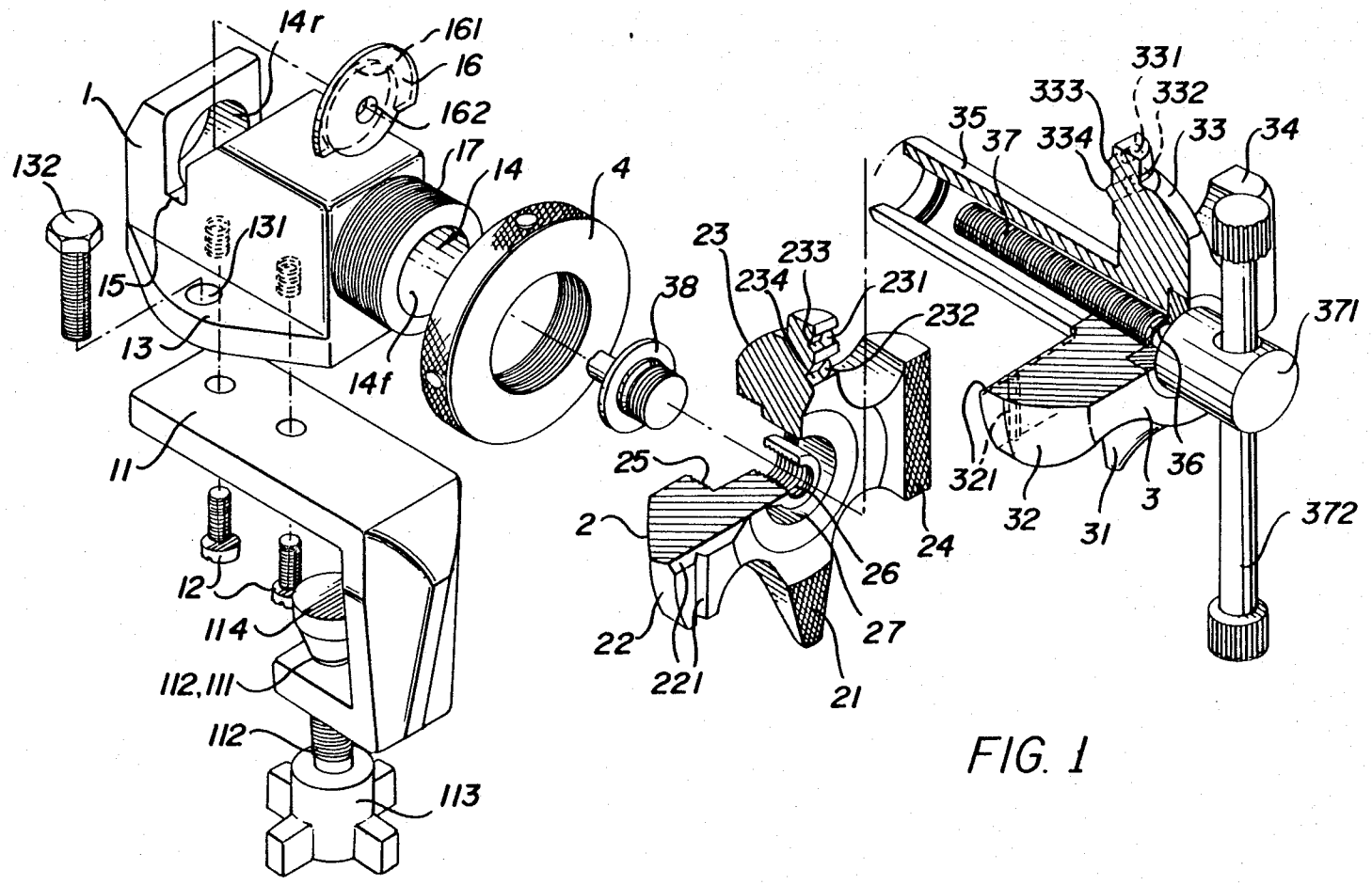
FIG. 1 is an exploded perspective view with portions cut away of this versatile vise in accordance with the present invention.

This versatile vise comprises a front jaw 3, a back jaw 2, and a jaw holder 1 provided with a sustaining base 11 which is combined with the jaw holder 1 with bolts 12. The sustaining base 11 is provided with a screw hole 111 for a screw 112 to engage with. The screw 112 is combined with a turning button 113 at the lower end and with a cap 114 at the upper end. The turning button 113 is turned to rotate the screw 112 so that the cap may be tightened against a working bench to steady this vise on the bench.

Moreover, the jaw holder 1 is provided with two ears 13 at the rear and the left sides. Each ear 13 is provided with a hole 131 for a bolt 132 to penetrate to steady this vise on a working bench if the sustaining base 11 cannot sufficiently pinch the bench.

The jaw holder 1 is also provided with a round shaft hole 14 which is divided by a groove 15 into a front long shaft hole **14*f* and a rear short shaft hole 14*r*. The rear short shaft hole 14*r* has inserted therein a smaller diameter part 161 of a punch plate 16. The punch plate 16 is provided with a central round hole 162 whose diameter is the same size as that of a punch 38 set in the front jaw 3**.

A male thread 17 is provided at the front part of the jaw holder 1 for a nut 4 and the back jaw 2 to engage with such that the back jaw 2 is able to be rotated for changing the position of jaw faces.

Next, the back jaw 2 is provided with jaw faces 21, 22, 23, 24 corresponding to jaw faces 3114 34 of the front jaw 3. The jaw face 21 has crisscross shallow lines with a gradually narrowing end for pinching a rather small thing or extending into a tube. The jaw face 22 has a cross groove 221 for pinching a round tube or sustaining a tube therein. The jaw face 23 has two different-sized half-round grooves 231, 232 and a trapezoid groove 233, 234 in said half-round groove 231, 232 for pinching a terminal with a wire for joining them together. The jaw face 24 has crisscross lines for tight pinching.

The back jaw 2 is also provided with a female thread 25 for engaging with the male thread 17 of the jaw holder 1, the female thread 25 being turned to change the position of the jaw faces 21–24 of the back jaw 2 and the nut 4 being turned to tighten the back jaw 2 after the position of said jaw faces 21–24 is changed. In addition, a screw hole 26 is provided through the center of the back jaw 2 for a screw 37 to engage with, and a C-shaped hole 27 is provided at the outside surface for a tube shaft 35 to be mounted therein so that the tube shaft 35 can move depending on the C-shaped hole 27.

The front jaw 3 is provided with jaw faces 31, 32, 33, 34 corresponding to the jaw faces 21–24 respectively; the jaw face 32 having a cross groove 321 and, the jaw face 33 having two different-sized half-round grooves 331, 332. The grooves 331, 332 have protrusions 333, 334 separately to adapt to the trapezoid grooves 233, 234 on the jaw face 23 of the back jaw 2 for joining a wire with a terminal by pinching them together. A material to be worked on can be pinched between one of the jaw faces 21–24 and the jaw faces 31–34 according to the shape of the material. In addition, the front jaw 3 is provided with a tube shaft 35 having a groove with the tube shaft 35 penetrating the C-shaped hole 27 of the back jaw 2. A C-shaped ring 36 is set at the center of the tube shaft 35 confining a screw 37 such that the screw 37 can rotate at its original position. The screw 37 is combined with a handle 372 for being easily rotated by the handle 372 so that the front jaw 3 can be moved nearer to or further from the back jaw 2 when the screw 37 is rotated.

A punch 38 is fixed at the rear end of the tube shaft 35 for punching a hole in a material by advancing into the round hole 162 in the punch plate 16 with the movement of the tube shaft 35.

Figure 3:
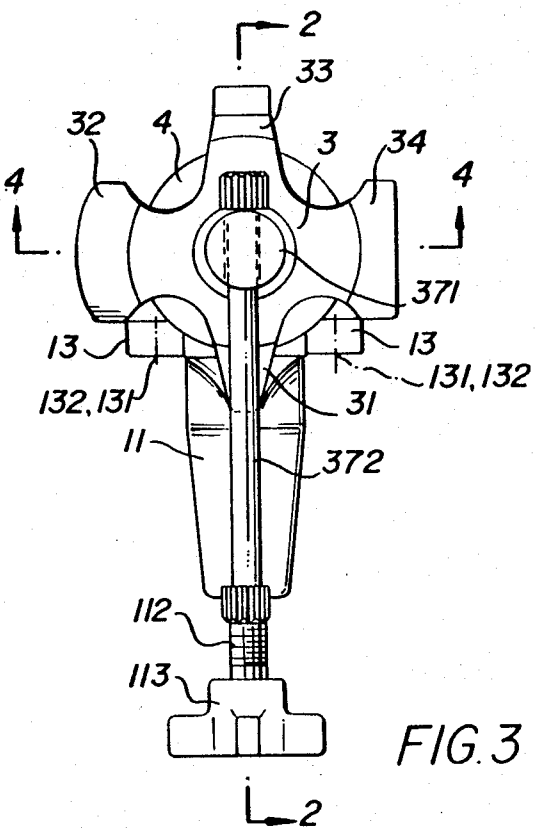
FIG. 3 is a side view of FIG. 2.
Figure 2:
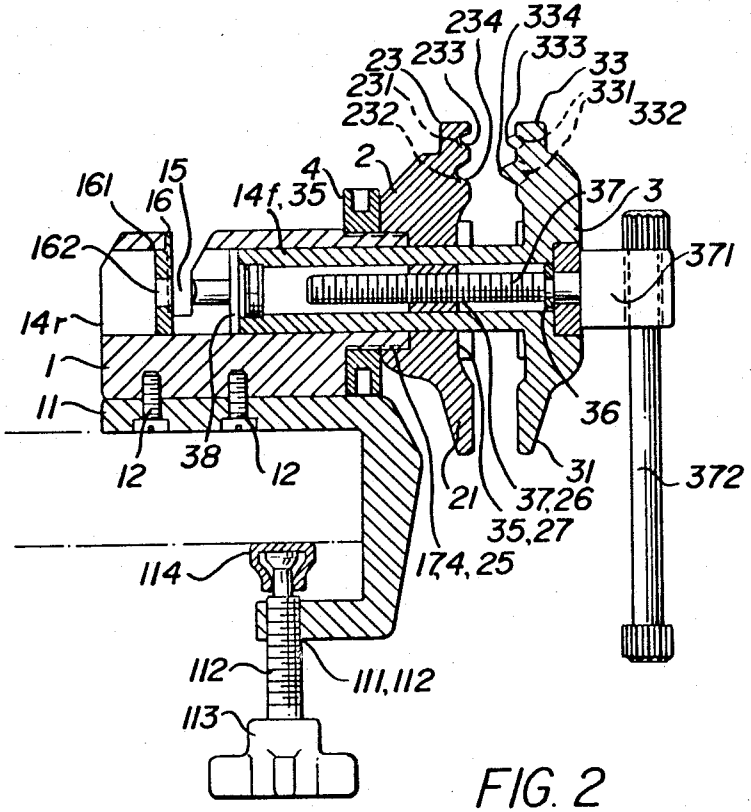
FIG. 2 is a cross sectional view take along line 2—2 of FIG. 3.
Figure 4:
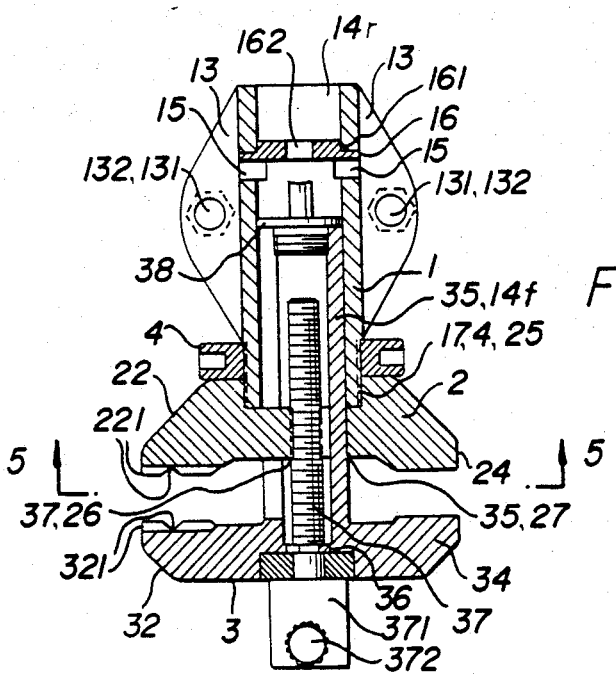
FIG. 4 is a cross sectional view take along line 4—4 of FIG. 3.
Figure 5:
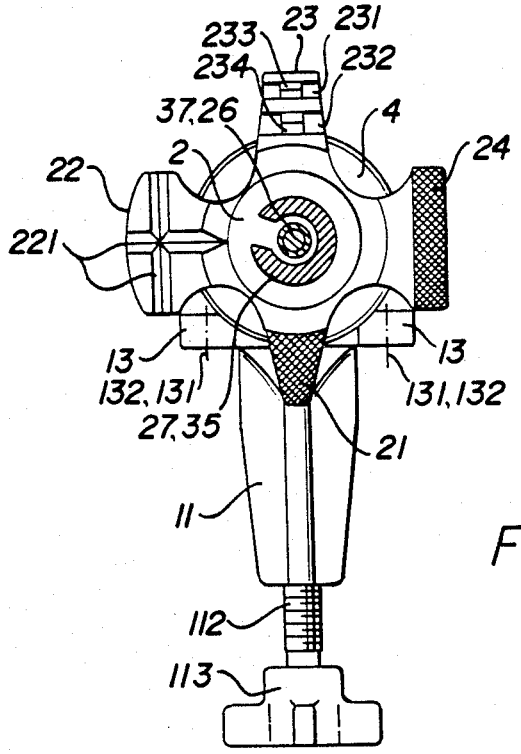
FIG. 5 is a cross sectional view take along line 5—5 of FIG. 4.

Next, FIG. 2 (a cross sectional view take along line 2—2 of FIG. 3) shows that the tube shaft 35 is set in the shaft hole 14 of the jaw holder 1, passing through the C-shaped hole 27 of the back jaw 2. Also, the front jaw 3 has the C-shaped ring confining the screw 37, which engages with the threaded hole 26 of the back jaw 2.

Therefore, the front jaw 3 can be moved by the rotation of the screw 37 nearer to or further from the back jaw 2. If the front jaw 3 is moving nearer and nearer the back jaw 2, the punch 38 at the end of the tube shaft 35 is also moving into the round hole 162 of the punch plate 16 and the material placed in the groove 15 (i.e., between the punch 38 and the punch plate 16) can be punched with a hole. The punch 38 and the punch plate 16 are changeable according to the size of the hole desired to be punched.

Lastly, fixing this vise on a work bench is effected either with the sustaining base 11 or with the ears 13 properly utilize. For pinching a material for work there are a plurality of jaw faces selectable according to the shape of a material or a thing. In addition, punching a hole in a material can also be done with the punch 38 and the punch plate 16 that are changable for the size of the hole wanted.

What is claimed is:

1. A versatile vise comprising:

a jaw holder having a base, said jaw holder including a longitudinal shaft hole which is separated by a lateral groove into a rear hole and a front hole, said longitudinal shaft hole having a hole axis;

an attaching means for attaching said base to a surface;

a punch plate including a central hole mounted in said rear hole of said longitudinal shaft hole adjacent said front hole;

a back jaw including a central C-shaped ring defining a central threaded hole and a C-shaped hole thereabout, and a plurality of back jaw faces disposed about said central ring;

a mounting means for mounting and locking said back jaw to said jaw holder such that said back jaw is rotatable about the hole axis to bring one of said jaw faces to a working position and then said back jaw is lockable to hold the one of the jaw faces in the working positions;

a front jaw including a central C-shaped tube shaft and a plurality of front jaw faces disposed about said central tube shaft, said C-shaped tube shaft having a distal end away from said front jaw faces and being received about said C-shaped ring in said C-shaped hole of said back jaw such that said front jaw rotates as said back jaw rotates;

a screw which is mounted for free rotation in said front jaw and which is threadably received in said central threaded hole of said C-shaped ring of said back jaw such that rotation of said screw causes said front jaw to be displaced relative to said back jaw, to pinch an object therebetween by rotation in one direction and to allow removal of a pinched object by rotation in the other direction; and a punch which is mounted to said distal end of said tube shaft such that said punch is moved into said central hole of said punch plate and through an object disposed in said lateral groove as said screw is rotated to move said front jaw toward said back jaw.

2. A versatile vise as claimed in claim 1 wherein said mounting means includes an externally threaded member which extends from said jaw holder about the hole axis, an internally threaded cavity in said back jaw which is threadably received on said externally threaded member to mount said back jaw to said jaw holder, and a locking nut threadably received on said externally threaded member between said back jaw and said jaw holder such that after rotation of said back jaw on said externally threaded member to position one of said back jaw faces in the working position said locking nut is rotated about said externally threaded member to bear against said back jaw to lock said back jaw against further rotation.

3. A versatile vise as claimed in claim 2 wherein said attaching means includes ears extending from said base which said ears include respective bolt holes therein, and respective attaching bolts which are received in the surface after passing through respective said bolt holes.

4. A versatile vise as claimed in claim 1 wherein said front jaw faces and said back jaw faces are arranged in opposed pairs, with each said front jaw face and back jaw face of a said pair complementing each other so that the object is suitably held therebetween.

5. A versatile vise as claimed in claim 1 and further including a first removable mounting means for removably mounting said punch plate in said rear hole of said longitudinal shaft hole and a second removable mounting means for removably mounting said punch to said distal end of said tube shaft whereby different combinations of punches and punch plates are useable.

* * * * *